US005431997A

United States Patent [19]

Scott et al.

[11] Patent Number: 5,431,997

[45] Date of Patent: Jul. 11, 1995

[54] PROCESS OF PRODUCING POROUS WEB MATERIALS USED FOR MAKING INFUSION PACKAGES FOR BREWING BEVERAGES AND THE WEB MATERIALS THUS PRODUCED

[75] Inventors: Peter C. Scott, Enfield; Helen Viazmensky, South Windsor; Nicholas Wolcheck, Jr., Suffield, all of Conn.

[73] Assignee: The Dexter Corporation, Windsor Locks, Conn.

[21] Appl. No.: 86,673

[22] Filed: Jul. 1, 1993

[51] Int. Cl.[6] ..... B32B 27/00

[52] U.S. Cl. ..... 428/290; 206/0.5; 426/77; 426/84; 428/289; 428/311.1; 428/311.7; 428/306.6; 428/308.8; 428/446; 428/449; 428/511

[58] Field of Search ..... 428/289, 290, 311.1, 428/311.7, 511, 446, 449, 306.6, 308.8; 426/77, 84; 206/0.5

[56] References Cited

U.S. PATENT DOCUMENTS

| | | | |
|---|---|---|---|
| 2,852,795 | 9/1958 | Hermanson et al. | 15/131.1 |
| 3,174,889 | 3/1965 | Anderson et al. | 156/254 |
| 3,183,096 | 5/1965 | Hiscock | 99/77.1 |
| 3,373,043 | 3/1968 | Rubenstein | 99/77.1 |
| 3,386,834 | 6/1968 | Noiset et al. | 99/77.1 |
| 3,468,696 | 9/1969 | Conway | 117/62.1 |
| 3,616,166 | 10/1971 | Kelley | 161/148 |
| 3,881,987 | 5/1975 | Benz | 162/116 |
| 4,289,580 | 9/1981 | Elston et al. | 162/109 |
| 4,902,370 | 2/1990 | Dust et al. | 156/327 |
| 5,015,513 | 5/1991 | Newbold et al. | 428/35.5 |

*Primary Examiner*—James J. Bell

*Attorney, Agent, or Firm*—Chilton, Alix & Van Kirk

[57] ABSTRACT

A porous web material for making infusion packages having enhanced mechanical seam integrity is obtained by treating the entire fibrous web material with an aqueous emulsion of a hydrophobic agent selected from the group consisting of high molecular weight cross-linked acrylic polymers, silicones, fluorohydrocarbons, paraffins, alkyl ketene dimers and stearylated materials. The hydrophobic agent, which may also act as a strength imparting binder, is preferably applied as a saturating treatment. The treated web is subsequently dried to insolublize the agent on the web. The web exhibits no appreciable water climb when measured using water at a temperature of about 100° C. and no substantial loss of infusion characteristics while providing less than 10 percent failure in a mechanical seam therein when exposed to boiling water.

16 Claims, No Drawings

PROCESS OF PRODUCING POROUS WEB MATERIALS USED FOR MAKING INFUSION PACKAGES FOR BREWING BEVERAGES AND THE WEB MATERIALS THUS PRODUCED

BACKGROUND OF THE INVENTION

The present invention relates generally to fibrous web materials and more specifically is concerned with a process of producing porous web materials used for making infusion packages for brewing beverages, such as tea, coffee and the like and with the web materials thus produced.

It has generally been the practice in making individual cups of tea to either place the bag of tea or the like in a cup containing boiling water, or alternatively, to place the bag in an empty cup and subsequently add the boiling water. In either event, the tea bag generally tends to inflate and float to the top of the water for a time despite the high porosity of the infusion paper utilized in making the tea bags. This inflation or "ballooning effect" is generally attributable to entrapped gases and vapors within the bag that are unable to escape due to a very thin film of water surrounding the bag. The entrapped gases, both condensible and noncondensible, tend to build up a positive pressure within the bag, frequently causing opening of the seams of mechanically sealed bags, thus undesirably discharging the tea leaves into the brew and defeating the purpose of using the bag. In the mechanically sealed tea bags, the edges of the web material are brought together, folded a number of times, and the multiple fold is crimped to provide a mechanical seam securing the two edges of the web material. The mechanically sealed bags are to be distinguished from heat sealed bags where a heat seal material, usually present within the web, is subject to heat and pressure to form a heat sealed seam.

Although seam failure and leakage of tea leaves has been evidenced for some time, it has been noticed that the incidence of failure was higher when certain strength imparting binder systems were used in the infusion web material. For example, increased seam failure has been noted with binder systems using carboxy methyl cellulose (CMC) and a reaction product of epichlorohydrin and a polyamide sold under the trade name Kymene as compared with the viscose (cellulose xanthate) bonding system widely used prior thereto. Changing the binder to latex binder materials that impart comparable tensile strength to the web material, such as ethyl vinyl acetate, cross linked polyvinyl alcohol or polyvinyl chloride, appear to provide no improvement in seam integrity and may even result in significantly higher instances of seam failure and leakage.

The treatment of infusion web material in discontinuous areas with water repellent material is disclosed by Noiset et al in U.S. Pat. No. 3,386,834 as one way of minimizing the ballooning effect. The repellent treated areas are isolated spots covered from 0.1 to 40 percent of the surface of the infuser material. Additionally, Elston et al in U.S. Pat. No. 4,289,580 achieved improved infusion in heat seal tea bags when using synthetic pulp as the heat seal phase, provided that the heat seal phase is disrupted over 10 to 75 percent of the total exposed surface area. That patent notes the disadvantages with respect to infusion properties when the hydrophobic synthetic pulp phase is not disrupted. The permeability of the web material is reduced together with its wettability, and the infusion is substantially retarded or inhibited.

SUMMARY OF THE INVENTION

In accordance with the present invention, it has been found that the above and related disadvantages can be avoided and mechanical seam integrity can be enhanced by treating the entire web material with a latex dispersion of a hydrophobic agent to provide a porous tea bag material which exhibits an extremely low absorbency and wettability as measured by standard water climb test procedures coupled with a retention of its infusion characteristics. The use of such material prevents the buildup of differential pressures on opposite sides of the web and facilitates the passage therethrough of condensible and noncondensible gases without adversely affecting the ability of such material to confine the dispersion of fine solid particles. The present invention achieves these characteristics by employing a hydrophobic treatment system that saturates and completely impregnates the entire web material. Although the use of a hydrophobic agent on the entire web material intended for use as an infusion material may be contraindicated, as set forth in Elston et al U.S. Pat. No. 4,289,580, it has been found in accordance with the present invention that infusion is not adversely impacted and resistance to mechanical seam failure is significantly enhanced.

Other features and advantages of the present invention will be in part obvious and in part pointed out more in detail hereinafter.

These and related advantages are achieved by providing an infusion web exhibiting improved resistance to the failure of a mechanically-crimped seam therein. The web consists of a porous fibrous sheet material impregnated throughout its extent with at least one percent by weight of a hydrophobic agent, preferably a strength imparting hydrophobic binder. Alternatively, a bonded web material may be impregnated throughout with a water repellent material. The impregnated sheet material advantageously exhibits no appreciable water climb when measured using water at a temperature of about 100° C. and no significant loss of infusion characteristics while providing less than 10 percent failure in the mechanical seam, and preferably no failure whatsoever, upon exposure to boiling water. A latex dispersion of the hydrophobic agent preferably is applied to the entire web as a saturating solution.

A better understanding of the invention will be obtain from the following detailed disclosure of the article and the desired features, properties, characteristics, and the relation of elements as well as the process steps, one with respect to each of the others, as set forth and exemplified in the description and illustrative embodiments.

DESCRIPTION OF A PREFERRED EMBODIMENT

Broadly, the present invention comprises a continuous, infuser web material impregnated throughout its extent with a hydrophobic agent, preferably in the form of a latex binder system. In order that the invention may be more clearly understood and for purposes of simplicity and brevity of discussion, the present invention will be discussed with relation to its use as tea bags and the like. The infuser tea bag webs are generally made of fibrous materials that are free from perforations or punctures yet possess a high degree of porosity and particularly are those wet laid fibrous materials made on conventional papermaking machines.

As used herein the term "hydrophobic" refers to the characteristic of the treating agent that imparts to the web material a resistance to, or the ability to avoid, wetting with water. The hydrophobic material imparts an aversion to or lack of affinity for water and resists the passage of liquid water into the structural components of the paper through capillary action. Since the absorbent character of the fibrous web material is best measured by its "water climb", the absence of such water climb is a primary indicator of its hydrophobic character. The water climb is a measure of the rate at which the web material absorbs water by capillary action, that rate being a relationship between distance and time. The rate is reported in units of time, such as seconds, needed to travel a fixed distance, such as one inch. Also, since hot water typically is used to brew tea, the water climb is given for both hot and cold water, with the hot water value being particularly relevant for this application.

The present invention in its application to tea bags permits the use of commercially available, self-supporting infuser webs. These webs are generally soft, tissue-thin fibrous materials characterized by light weight but, when used as described hereinbefore, possess the disadvantage of somewhat limited seam integrity in boiling water. The webs are of the nonheat-seal variety and require mechanical fastening, i.e., folding and crimping, for the formation of the tea bag. Typical are the loosely formed, low density papers made of long natural fibers as described in Osborne U.S. Pat. Nos. 2,045,095 and 2,045,096.

The fibers utilized in these webs may be of any of the well-known papermaking fibers or mixtures thereof. They should be those approved for use in food and beverage applications and may include natural fibers such as jute, bleached or unbleached kraft, abaca, sisal, and other wood fibers as well as lesser amounts of approved synthetic fibers.

A variety of infuser webs may be made from these fibers and utilized in accordance with the present invention; however, for purposes of discussion, the invention will be described in its application to commercially available infuser web materials. It will be appreciated that such materials, while being extremely porous and highly wettable, are generally free from perforations and will not permit the fine dust particles of the tea to filter through the bags made therefrom.

According to the preferred aspect of the present invention, the continous infuser webs are treated throughout their entire extent with a suitable hydrophobic agent which, when set or cured, is insoluble in aqueous solutions and unaffected by boiling water. The hydrophobic agents utilized must provide not only a resistance to wetting or aqueous absorption as measured by water climb, but also must provide this property without adversely affecting the infusion characteristics of the web throughout the treated areas. Additionally, these water repellent agents utilized according to the invention should exhibit an affinity for being readily absorbed into the fibers of the web while substantially retaining the porosity of the web. Accordingly, they are distinguished from materials which form solid films over the treated area.

Those materials found most suited for this type of application are strength imparting binders used in place of the binder systems employed heretofore or as supplemental treatments in addition to the conventional binder. When employed as substitutes for prior binders, they also must be effective to provide the strength imparting characteristics of the conventional binder systems. Those found to be particularly effective as hydrophobic binders are the materials generally categorized as acrylic polymers and, more particularly, as latex dispersions or emulsions of alkyl acrylate polymers and copolymers. These materials are preferred due to their ability to substantially permeate the filaments or fibers of the infuser web without blocking or interfering with the porous openings between the fibers. Although various alkyl acrylates, including mixtures thereof, may be utilized, those used must be hydrophobic and prevent the treated web from exhibiting absorptive water climb in both hot and cold water. The preferred materials are alkyl acrylates such as ethyl acrylate and butyl acrylate polymers, copolymers and interpolymers, such as the ethyl acrylate copolymer and butyl acrylate copolymer sold by B. F. Goodrich Company under the respective tradename designations HYCAR 26-315 and 26-373 as well as the copolymer of ethyl acrylate and butyl acrylate sold by Rohm & Haas under the designation "Rhoplex NW-1715". These materials show little or no transfer to the brew after cure, are generally nontoxic and do not affect the odor, taste or quality of the brew produced, all of which are important and necessary characteristics in food and beverage products. Of course, all exhibit the requisite hydrophobic character.

The hydrophobic agent may be applied to the preformed infuser web material by well-known techniques used to add binders while assuring complete coverage of the web material. For example, the web may be treated by brush, roll, spray or immersion bath to effectuate the desired application to the web material. Since complete impregnation of the web is desired, a saturation treatment is preferred. The alkyl acrylate binder emulsions generally penetrate quickly through the rather thin and absorbent infuser web and may be applied during a suitable stage in the manufacture of the continuous fibrous web. For example, in a conventional papermaking machine, a saturating size press may be placed adjacent the dryer section prior to the final drying and collection of the web material.

After treating the infuser web with the latex dispersion of the alkyl acrylate binders, which immediately permeates through the entire thickness of the paper in the treated areas, the web then is subjected to a thermal or heat cure in order to set the binder and prevent leaching therefrom. This operation may be combined with the normal drying steps employed in making the infuser web. Although the latex binders may be air dried since they are self curing, heat curing during the drying operation is preferred. Consequently, by using proper techniques, complete coverage and adherence of the hydrophobic binder may be readily achieved.

The acrylate polymer emulsions may be employed in undiluted form or the aqueous emulsions may be diluted to provide the desired binder concentration and pick up by the web during saturation. The concentration range of the copolymer within commercially sold emulsions is typically in the high solid range of about 55–60 percent by weight with a viscosity of about 90 cps. However, the commercial emulsions typically are diluted by about 3:1 to 20:1 and preferably 5:1 to 10:1 prior to use such that the pick up by the web will be from about 3 percent to 20–25 percent by weight. Although the hydrophobic character of the binder will be effective to provide improved seam integrity at a pick up level of only about 1 percent by weight; at least 3–4 percent binder is preferably employed to impart adequate stiffness to the web to facilitate handling on commercial seam forming machinery. For conventional tea bags, a binder pick up of about 8–10 percent is preferred. With larger "family size" tea bags, as much as 15–20 percent binder pick up may be used.

The web material treated with a hydrophobic binder of the type described, while retaining its porosity, exhibits substantially no absorption characteristics. As mentioned, these are measured by a "water climb" test procedure that determines the rate of saturation of a web material by capillary action. In accordance with this procedure, a strip of treated material is cut to a specimen size of one inch by five inches. The strip is mounted on a support bar above a container, such as a 500 ml. beaker, so that the strip will be suspended within the beaker. The specimen is marked at ½ inch and at 1½ inches from the bottom of the specimen. The beaker is partially filled with distilled water to a level such that the bottom ½ inch of the specimen will be immersed in the water. The time then is recorded for the water front to advance up the specimen to the 1½" mark, a distance of one inch. The test is stopped at 400 seconds if the water front has not advanced sufficiently to complete the one inch climb on the specimen. The time is reported for the one inch travel of the water front. If the water front does not move above the level of the water in the beaker, a report of "no absorption" is recorded.

The water climb absorbency rate test has been correlated to the number of seam failures in a standard teabag of the flow through type. The purpose of the seam failure test is to assess the ability of a tea bag seam to maintain its integrity during forces exerted on it in a harsh brewing condition. In accordance with this test procedure, a teabag of the flow through type is inverted so that the "W" fold is extending in an upward direction and the head fold in a downward direction, with the tea located adjacent the head fold. The teabag so oriented is placed in the bottom of a beaker with the head fold facing down. Tap water is heated to a constant boiling condition and approximately 400 ml. of boiling water is poured directly onto the teabag with the stream of water being maintained on the bag throughout the pour to provide a maximum degree of water flow turbulence upon the bag. The time for pouring the boiling water onto the teabag should take about 3 seconds. The container then is examined for tea leaves discharged by the teabag. Thereafter, the bag is removed and examined at both the center fold and the head fold for any openings therein. If any of the following conditions are present, the seam is considered to be a failure:

1. Tea leaves in the beaker;
2. Opening of the center fold area;
3. Opening of the head fold area.

Based on the foregoing, the determination is made as to either failure or non-failure of the seam.

Table 1 provides an indication of the direct relationship between the water climb value of papers treated with various binders and the percent of seam failures. The seam failures are based on a minimum of 20 teabags tested.

TABLE I

| | | Water Climb | | | | |
|---|---|---|---|---|---|---|
| | | Cold Water | | Hot Water (100° C.) | | Seam Failure |
| | Binder | MD | CD | MD | CD | (%) |
| A. | Viscose | 191 | 400+ | 72 | 262 | 30 |
| B. | Kymene/CMC | 35 | 69 | 46 | 70 | 50 |
| C. | Polyvinyl chloride | ½"* | ½"* | 292 | 370 | 75 |
| D. | Ethyl vinyl acetate | ½"* | ½"* | 303 | 400+ | 50 |
| E. | Ethyl acrylate copolymer | NA | NA | ¼"* | ½"* | 0 |
| F. | Butyl acrylate copolymer | NA | NA | NA | NA | 0 |
| G. | Copolymer of ethyl and butyl acrylate | NA | NA | NA | NA | 0 |

*Extent of water climb in 400 seconds
NA = no absorption

When the web material made with binder G was further treated with a surfactant, water climb values of 10 to 20 seconds were obtained coupled with 10 percent seam failures, thus indicating that the hydrophobic character of the binder as measured by the water climb was the significant factor in the seam failure results.

Measurements were also made to compare the time for the first color to appear in a tea brew using web materials with different binders. When samples B and F were compared, the first color infusion time varied by only 0.2 seconds with sample B having an infusion first color time of 6.7 seconds.

As mentioned, the hydrophobic agent used to treat the web material may also be applied to a prebonded sheet to achieve the beneficial result of the present invention. In accordance with this embodiment of the invention, the hydrophobic treating agent may be any of a number of fluid-repellent materials, such as silicones, fluorohydrocarbons, parafins, alkyl ketene dimers, stearylated materials and the like. The silicones may be any of those materials mentioned in U.S. Pat. No. 3,386,834, the disclosure of which is incorporated herein by reference. The silicone pick up varies from 10–30 percent by weight. Where a fluorochemical treating agent is employed, it should, of course, meet the standards for use with foods and beverages and preferably should be in the form of an aqueous emulsion for ease of application. A typical aqueous emulsion formulation contains about 0.7 to 1.5 parts by volume of a fluorohydrocarbon for each hundred parts of water and may employ materials such as the Scotchban treating agent sold by Minnesota Mining and Manufacturing under the designation "FC-809" or "FX-845". Other fluorohydrocarbon materials that can be employed include the DuPont material designated Zonyl RP or NF. The parafin and stearylated materials include those sold by Sequa Chemicals Company under the tradename Sequapel, such as Sequapel 414 and 417, while the alkyl ketene dimers are exemplified by Hercon 70 sold by Hercules Chemical Company.

Where a material using viscose binder, as shown in sample A of Table I, was saturated with a solution containing 0.3 percent of a fluorohydrocarbon, the water climb values for both hot and cold water were comparable to samples F and G, namely no absorption. A similar situation was evidenced when a web containing binder B of Table I was saturated with an emulsion containing 25 percent silicone (a mixture of methyloxypolydimethyl siloxane and polydimethyl siloxane supplied by General Electric under the name Silicone II). The same result is achieved when the web material using binder B is treated with a fluorohydrocarbon at a fluorocarbon treatment level of 0.3 percent. This material also exhibits no seam failures although the appearance of first color is slightly slower.

As will be appreciated, the repellent may be added as a separate treatment to a bonded web material or may be added to the conventional binder to be applied simultaneously therewith to the web material.

As can be seen from the foregoing, the present invention provides infuser web material possessing improved mechanical seam integrity as a result of impregnating the web with a hydrophobic treating material in a latex dispersion. The latex may be used as a replacement for binder systems used heretofore or as a supplement thereto.

As will be apparent to persons skilled in the art, various modifications and adaptations of the web material above described will become readily apparent without departure from the spirit of the invention.

We claim:

1. A fibrous web suited for making infusion packages for brewing beverages and exhibiting improved resistance to the failure of a mechanical seam therein, said web comprising a porous fibrous sheet material impregnated throughout its extent with about one percent or more by weight of a hydrophobic treating system comprising a cured hydrophobic agent selected from the group consisting of high molecular weight cross-linked acrylic polymers, silicones, fluorohydrocarbons, paraffins, alkyl ketene dimers and stearylated materials, the impregnated sheet material exhibiting no appreciable water climb when measured using water at a temperature of about 100° C. and no substantial loss of infusion characteristics while providing less than 10 percent failure in the mechanical seam upon exposure to boiling water.

2. The infusion web of claim 1 wherein the hydrophobic agent that completely impregnates the entire web material comprises at least 3–4 percent by weight of the web material.

3. The infusion web of claim 1 wherein the hydrophobic agent is a high molecular weight alkyl acrylate strength imparting hydrophobic binder.

4. The infusion web of claim 3 wherein the hydrophobic binder is selected from the group consisting of ethyl acrylate and butyl acrylate polymers and copolymers.

5. The infusion web of claim 1 wherein the hydrophobic agent comprises up to about 8–12 percent by weight of the web material and the mechanical seam failure of the web is less than one percent.

6. The infusion web of claim 1 wherein the hydrophobic agent is a strength imparting hydrophobic binder comprising a high molecular weight cross-linked butyl acrylate copolymer.

7. The infusion web of claim 1 wherein the hydrophobic agent is a hydrophobic strength imparting binder completely impregnating the entire web material and imparting sufficient resistance to wetting to eliminate the water climb of the fibrous sheet material, the hydrophobic binder exhibiting an affinity for being readily absorbed into the fibers of the web, the binder being a high molecular weight cross-linked alkyl acrylate polymeric material.

8. The infusion web of claim 1 wherein the fibrous sheet material contains a strength imparting binder other than the hydrophobic agent.

9. The infusion web of claim 8 wherein the hydrophobic agent comprises from 0.3 to 30 percent by weight.

10. A process for producing porous web materials for making infusion packages having enhanced mechanical seam integrity comprising the steps of providing a porous absorbent web material suited for use as an infusion package, treating the entire web material with an aqueous emulsion of a hydrophobic agent selected from the group consisting of high molecular weight cross-linked acrylic polymers, silicones, fluorohydrocarbons, paraffins, alkyl ketene dimers and stearylated materials to provide a treated web that exhibits no appreciable water climb when measured using water at a temperature of about 100° C. and less than 10 percent failure in a mechanical seam therein when exposed to boiling water.

11. The process of claim 10 wherein the aqueous emulsion of the hydrophobic agent exhibits an affinity for being readily absorbed into the fibers of the web and the process includes the step of subsequently insolubilizing the agent on the web.

12. The process of claim 10 wherein the hydrophobic agent is a cross-linked high molecular weight acrylic polymer which also acts as a strength imparting hydrophobic binder, the hydrophobic agent imparting resistance to aqueous absorption as measured by water climb and exhibiting an affinity for being readily absorbed into the fibers of the web, the treating step comprising a saturating treatment and the process includes the step of subsequently drying the treated web material.

13. The process of claim 12 wherein the binder is a latex dispersion of an alkyl acrylate, the latex binder being present in an amount sufficient to provide a binder pick up by the web of at least 3–4 percent by weight.

14. The process of claim 10 wherein the fibrous sheet material is soft, tissue weight material, the process including the step of treating the web with a binder in addition to the hydrophobic treating agent, said agent exhibiting an affinity for being readily absorbed into the fibers of the web, said hydrophobic agent being applied as a latex dispersion in an amount sufficient to impart a hydrophobic agent pick up of about 0.3 to 30 percent by weight.

15. The process of claim 10 wherein the fibrous sheet material is a prebonded, light weight, highly wettable material and the hydrophobic agent imparts complete resistance to wetting as measured by water climb, the hydrophobic agent exhibiting an affinity for being readily absorbed into the fibers of the web and being applied by a size press.

16. The process of claim 10 wherein the hydrophobic treating agent completely impregnates the web material as the web material is being treated with a strength imparting binder.

* * * * *